US006829991B1

(12) United States Patent
Eaton

(10) Patent No.: US 6,829,991 B1
(45) Date of Patent: Dec. 14, 2004

(54) INKER DRIVEN SHAFTLESS UNIT

(75) Inventor: Jared Paul Eaton, Stratham, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/696,194

(22) Filed: Oct. 29, 2003

(51) Int. Cl.[7] ..... B41F 7/02; B41F 13/10; B41L 47/14

(52) U.S. Cl. ..... 101/217; 101/216; 101/212; 101/375; 101/477; 101/492; 476/18; 476/19; 475/1; 475/2

(58) Field of Search ..... 101/216, 217, 101/212, 477, 492, 375; 476/18, 19, 26; 475/1, 2

(56) References Cited

U.S. PATENT DOCUMENTS

| | | | | | |
|---|---|---|---|---|---|
| 4,953,461 | A | * | 9/1990 | Gaffney et al. | 101/142 |
| 5,027,706 | A | * | 7/1991 | Niemiro et al. | 101/366 |
| 5,694,848 | A | * | 12/1997 | Palmatier | 101/219 |
| 5,979,317 | A | | 11/1999 | Singler | 101/218 |
| 6,050,185 | A | * | 4/2000 | Richards | 101/142 |
| 6,119,593 | A | * | 9/2000 | Pollock | 101/349.1 |
| 6,216,592 | B1 | | 4/2001 | Knauer et al. | 101/247 |
| 6,338,298 | B2 | * | 1/2002 | Schneider et al. | 101/179 |
| 6,378,427 | B1 | * | 4/2002 | Endisch | 101/349.1 |
| 6,408,748 | B1 | | 6/2002 | Hajek et al. | 101/177 |
| 6,668,721 | B2 | * | 12/2003 | Naka | 101/218 |
| 2002/0096066 | A1 | | 7/2002 | Callahan et al. | 101/183 |

FOREIGN PATENT DOCUMENTS

| | | |
|---|---|---|
| EP | 0699524 | 3/1996 |
| EP | 1226937 | 7/2002 |
| JP | 2120048 | 5/1990 |

* cited by examiner

*Primary Examiner*—Andrew H. Hirshfeld
*Assistant Examiner*—Marvin P. Crenshaw
(74) *Attorney, Agent, or Firm*—Davidson, Davidson & Kappel, LLC

(57) ABSTRACT

A printing unit of an offset printing press includes a first plate cylinder, a first blanket cylinder for selectively contacting the first plate cylinder, a first inker for inking the first plate cylinder, a second plate cylinder, a second blanket cylinder for selectively contacting the second plate cylinder, and a second inker for inking the second plate cylinder. A first inker drive gear connects to the first inker for driving the first inker, and a motor uniquely associated with the printing unit is configured to drive the first inker drive gear. In addition, a gear train engaging the first inker drive gear is driven by the first inker drive gear so as to drive the first plate cylinder, the first blanket cylinder, the second blanket cylinder, the second plate cylinder and the second inker.

17 Claims, 3 Drawing Sheets

INKER DRIVEN SHAFTLESS UNIT

BACKGROUND INFORMATION

The present invention relates generally to printing presses and more particularly to a device and method for driving rolls and cylinders in a printing press.

Offset lithographic printing presses typically have a plate cylinder carrying an imaged plate. During printing, the plate is inked, and the inked image is transferred to a blanket which then contacts paper sheets or a continuous web of paper. Ink for the plate cylinder may be provided via an inker including an inker cylinder in rolling contact with the plate cylinder.

The drive for an offset lithographic printing press traditionally has included a common drive shaft running on a gear side of the printing press, with several printing units of the printing press engaging the shaft with worm gears and other gears to derive power from the shaft.

Shaftless drive configurations for lithographic offset printing presses use direct or indirect drive motors, which supply the necessary driving forces to the plate and/or blanket cylinders using one to four motors. The inker may be geared to the plate cylinder or may be driven by a separate or additional motor. Shaftless printing presses are described, for example, in U.S. Pat. Nos. 6,216,592 and 5,979,317.

Commonly-owned U.S. Pat. No. 6,050,185, hereby incorporated by reference herein, purports to disclose a shaftless drive with a first drive motor driving a first inker roller either directly or via a further drive. The first drive motor is mechanically coupled to the first plate cylinder via a first gear train, which may include a gear wheel mounted to the drive shaft of the first plate cylinder. A second drive motor drives another plate cylinder and inker roller. The first blanket cylinder and the second blanket cylinder of the press are mechanically coupled to one another and are driven by a third drive motor.

European Patent Application No. 0 699 524 purports to disclose an offset printing machine. Cylinder and functional groups are driven with minimum technical requirements. A printing unit is provided where the plate cylinders are each driven by a separate electric motor and are not mechanically coupled to each other. Independently driven cylinders in a folder are also disclosed.

Japanese Patent No. 212 00 48 purports to describe an ink roller driving device of a printer that intermittently rotates an ink main roller, swings or rotates a doctor roller and reciprocates ink reciprocating rollers with a driving motor.

U.S. Pat. No. 6,408,748 purports to describe using separate electric motors to drive inking and form or blanket cylinders of a printing unit.

Commonly-owned published U.S. patent application Publication No. US 2002/0096066, which is hereby incorporated by reference herein and related European Patent Application 1 226 937 A1, purport to disclose a shaftless motor drive for a printing unit having two inkers and two motors, each motor being directly connected to one of the two inkers.

BRIEF SUMMARY OF THE INVENTION

An object of the present invention is to provide a printing unit useable in a shaftless offset printing press.

An additional or alternate object of the present invention is to provide a printing unit having a gear train that is driven from the drive gear of an inker rather than by one or more gears of the plate or blanket cylinders.

A further additional or alternate object of the present invention is to provide a simple and effective solution for positively and accurately driving the cylinders of a printing unit so as to provide sufficient static gear preload and to avoid gear train backlash.

The present invention provides a printing unit that includes a first plate cylinder, a first blanket cylinder for selectively contacting the first plate cylinder, a first inker for inking the first plate cylinder, a second plate cylinder, a second blanket cylinder for selectively contacting the second plate cylinder, and a second inker for inking the second plate cylinder. The printing unit also includes a first inker drive gear connected to the first inker for driving the first inker, and a motor uniquely associated with the printing unit and configured to drive the first inker drive gear. The printing unit also includes a gear train engaging the first inker drive gear and being driven by the first inker drive gear so as to drive the first plate cylinder, the first blanket cylinder, the second blanket cylinder, the second plate cylinder and the second inker.

Using the inker drive gear to drive the entire gear train provides a driving point that is removed from the blanket and plate cylinders, allowing more space adjacent those cylinders for other desired components. This can be particularly advantageous, for example, for printing units with mechanisms attached to the plate cylinders or their gears for providing lateral and circumferential registering. The register mechanism may limit drive access to the plate cylinder gear. In addition, the axes of the plate and/or blanket cylinders may shift position slightly when the printing unit is taken off impression, which can be an additional problem if the drive point is attached to one or more of these cylinders. Moreover, the present invention provides an inexpensive solution to the problem of converting certain existing shaft driven presses with minimal modification of the existing gear train, particularly when the shafted presses are inker driven.

According to the present invention, the motor may directly engage the first inker drive gear, and may include a pinion for providing the engagement. The first inker drive gear may have a single teething that engages both the motor and the gear train, or may be a compound gear having a first teething engaging the motor and a second teething engaging the gear train. As used herein "compound gear" may be a single-piece gear having a plurality of teethings, or may be a plurality of gears connected to each other, such as by being mounted to a common shaft. Other variations for driving the first inker drive gear are also possible.

Preferably the gear train includes: a first plate drive gear driving the first plate cylinder and engaging the first inker drive gear; a first blanket drive gear engaging the first plate drive gear and driving the first blanket cylinder; a second blanket drive gear engaging the first blanket drive gear and driving the second blanket cylinder; a second plate drive gear engaging the second blanket drive gear and driving the second plate cylinder; and a second inker drive gear engaging the second plate drive gear and driving a second inker cylinder. Preferably, the first and second plate drive gears and the first and second blanket drive gears each drive a respective cylinder by being rigidly attached to an axle of the respective cylinder.

The gear train may include a plurality of gears, each associated with one of the first and second blanket cylinders, the first and second plate cylinders, and a cylinder of the second inker. Preferably, each of the blanket and plate drive gears in the gear train have a diameter equal to the diameter of the cylinder with which it is associated. Most preferably, the gears of the gear train all have the same diameter, thereby improving drive characteristics.

The present invention also provides a method of driving a printing unit. The method includes driving a first inker drive gear using a motor uniquely associated with the printing unit, driving a first inker connected to the first inker drive gear using the first inker drive gear, and driving a first plate cylinder, a first blanket cylinder, a second blanket cylinder, a second plate cylinder and a second inker using a drive train, the gear train engaging and being driven by the first inker drive gear.

BRIEF DESCRIPTION OF THE DRAWINGS

Exemplary embodiments of the present invention is described below by reference to the following drawings, in which.

DETAILED DESCRIPTION

Figure 1:
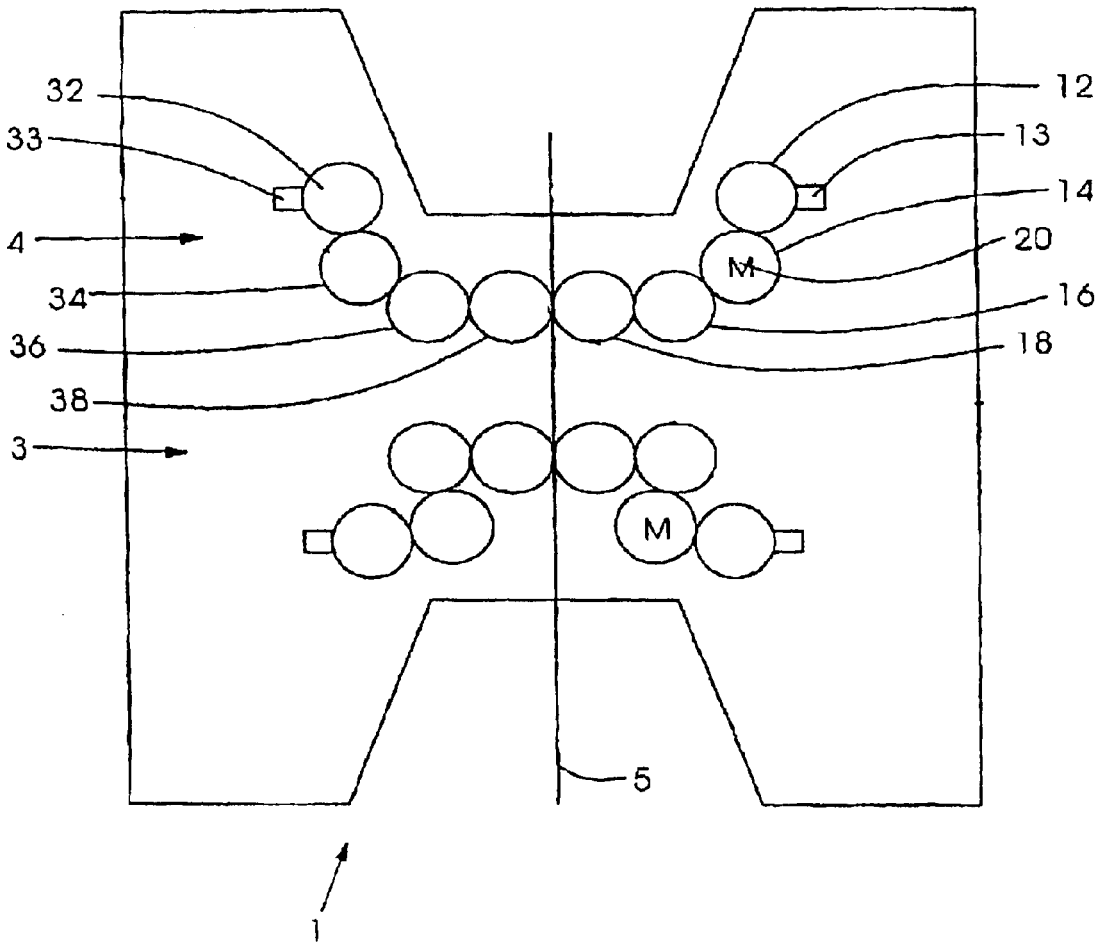
FIG. 1 shows a simplified side view of a shaftless printing press having two printing units according to the present invention.

FIG. 1 shows a gear side of one embodiment of a shaftless printing press 1 having two printing units 3 and 4. A web 5 is printable on both sides by the lithographic offset printing units 3, 4. Printing unit 4 includes a first print couple having a plate cylinder 16 and a blanket cylinder 18. An inker roll 12 associated with an ink chamber 13 and an inker cylinder 14, together define an inker, which is an anilox inker in this embodiment, but which also could be an ink fountain including a train of ink rolls. Inker cylinder 14 provides ink to the plate cylinder 16. Print unit 4 has a second printing couple having a plate cylinder 36 and a blanket cylinder 38. The blanket cylinders 18 and 38 function as impression cylinders for each other, and are in contact with the web when either or both of the print couples are printing. In press 1, the cylinders of the print unit 4 are driven by a motor 20 which drives an axle of the cylinder 14. Inker roll 32, associated with ink chamber 33 and inker cylinder 34, together define a second inker, which, in this embodiment, is an analox inker. Inker cylinder 34 provides ink to the plate cylinder 36.

Figure 2:
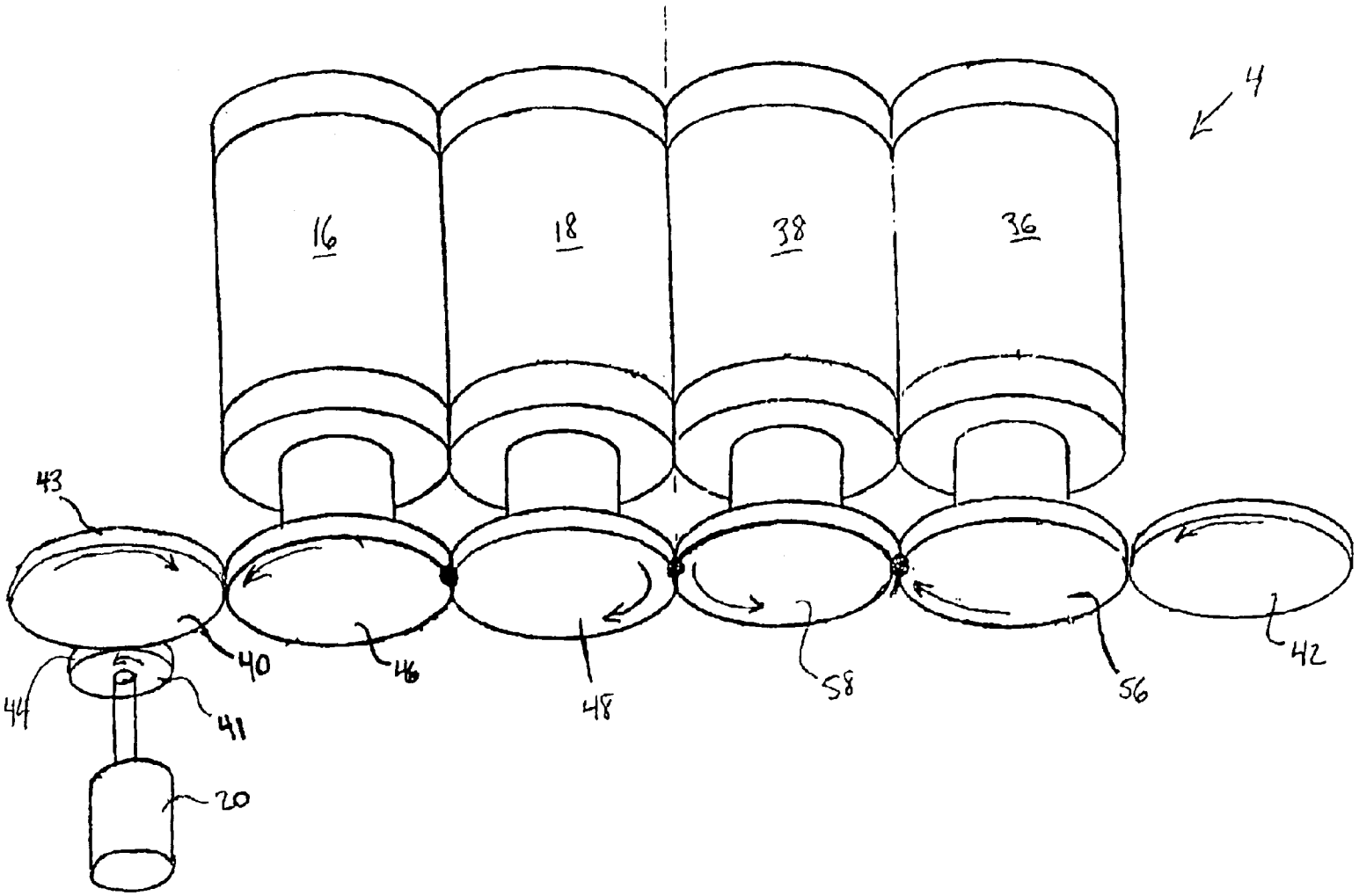
FIG. 2 shows a simplified top view of a first embodiment of a printing unit according to the present invention.

As shown in FIG. 2, motor 20 includes pinion 41, which engages inker drive gear 40. Inker drive gear 40 may drive inker cylinder 14 as in FIG. 1, via its axle, or may be associated with a series of inker gears for driving a plurality of inker cylinders. Pinion 41 includes a teething 44 on its outer circumference that meshes with teething 43 on the outer circumference of inker drive gear 40. Inker drive gear 40 engages plate cylinder drive gear 46, which drives an axle of plate cylinder 16. Plate cylinder drive gear 46 engages blanket cylinder drive gear 48, which drives an axle of blanket cylinder 18. Blanket cylinder drive gear 48 engages second blanket cylinder drive gear 58, which drives an axle of the blanket cylinder 38 of the second printing couple. Second blanket cylinder drive gear 58 engages second plate cylinder drive gear 56, which drives an axle of the plate cylinder 36 of the second printing couple. Second plate cylinder 56 engages second inker drive gear 42, which may drive an axle of inker cylinder 34 as in FIG. 1, or which may drive a series of inker cylinders using additional gearing. Thus, drive gears 46, 48, 58, 56, and 42, together define a gear train that engages and is driven by the inker drive gear 40. The gear train drives the plate cylinder 16, the blanket cylinder 18, the blanket cylinder 38, the plate cylinder 36, and the second inker, such as by driving inker cylinder 34.

Each of the cylinders 16, 18, 38, and 36, preferably have diameters that are equal to each other and that are equal to the diameters of the drive gears 46, 48, 58, and 56, of the gear train. The inker cylinders 14 and 34 may also have the same diameter of the plate and blanket cylinders, but often will have a smaller diameter. While it is not necessary for the drive gears to have the same diameter of the cylinders they are driving, doing so may simplify the configuration the gear train configuration and ensure that the cylinders are caused to rotate at the same speed as one another.

Figure 3:
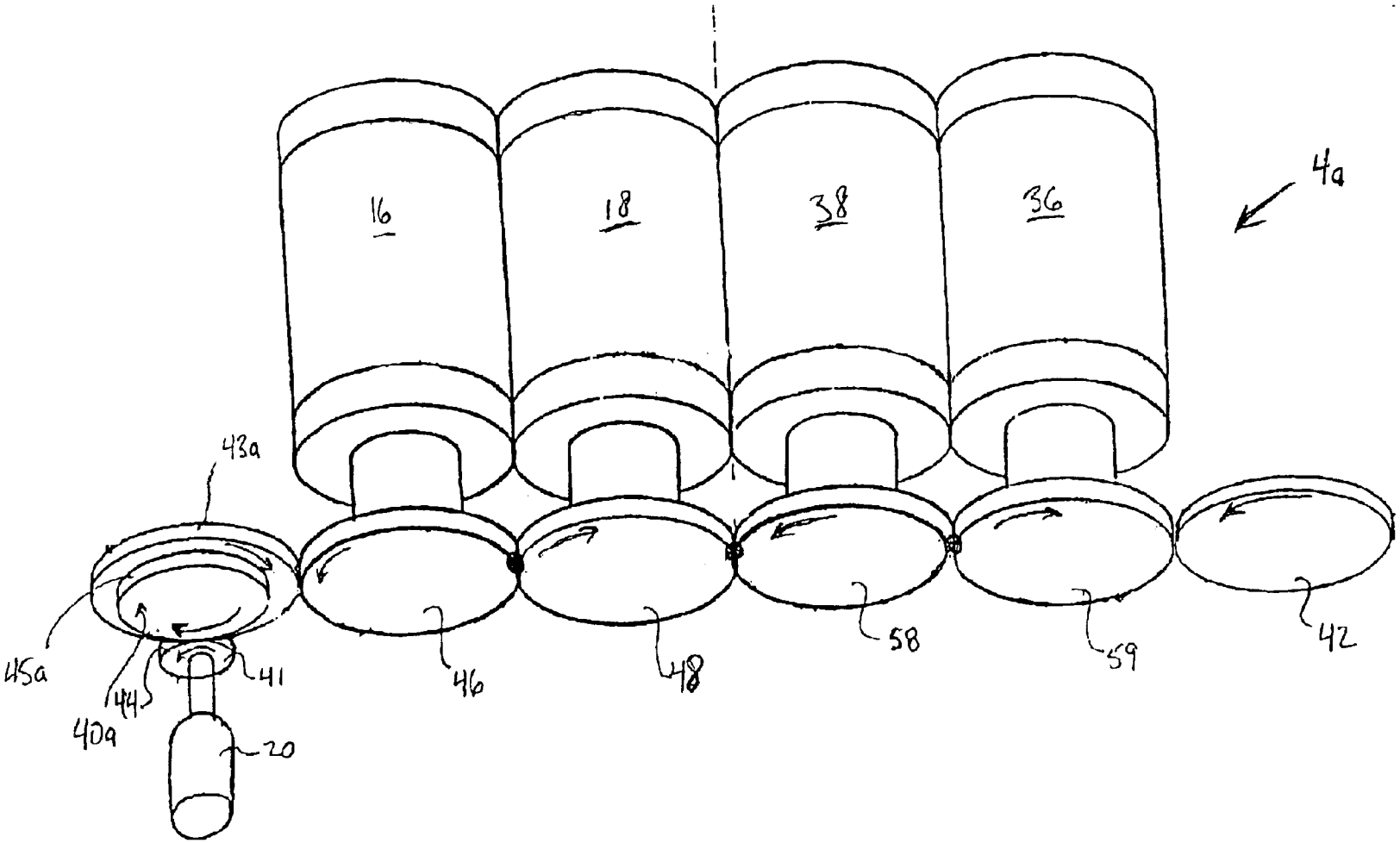
FIG. 3 shows a simplified top view of a second embodiment of the present invention.

FIG. 3 shows a second embodiment of the printing unit according to the present invention that differs slightly from the first embodiment. Printing unit 4*a* in FIG. 3, includes an alternate inker drive gear 40*a*, which has a first teething 43*a* on its outer circumference, and which also has a second teething 45*a* on an outer circumference of an axial extension portion of inker drive gear 40*a*. Pinion 41 of motor 20 has outer teething 44, which engages second teething 45*a*. First teething 43*a* engages plate cylinder drive cylinder 46 in a similar manner as in printing unit 4 in FIG. 2. Other variations for driving the first inker drive gear 40, 40*a* will also be apparent to a person of ordinary skill in the art.

The first inker shown in FIG. 1 is an analox inker including cylinders 12 and 14 and ink chamber 13, while the second inker includes cylinders 32 and 34 and ink chamber 33. The inkers used with the printing unit according to the present invention may have alternate configurations as well. For example, additional inker gears may be included, either as part of the above-mentioned gear train or as separate inker gear trains that may engage and be driven by the inker drive gear 40 for driving additional inker cylinders of the inker. "Plate cylinder" as defined herein may include any image-carrying cylinder.

What is claimed is:

1. A printing unit comprising:

a first plate cylinder;

a first blanket cylinder for selectively contacting the first plate cylinder;

a first inker for inking the first plate cylinder;

a second plate cylinder;

a second blanket cylinder for selectively contacting the second plate cylinder;

a second inker for inking the second plate cylinder;

a first inker drive gear connected to the first inker for driving the first inker;

a motor associated with the printing unit and configured to drive the first inker drive gear; and a gear train engaging the first inker drive gear and being driven by the first inker drive gear so as to drive the first plate cylinder, the first blanket cylinder, the second blanket cylinder, the second plate cylinder and the second inker.

2. The printing unit as recited in claim 1, wherein the motor directly engages the first inker drive gear.

3. The printing unit as recited in claim 1, wherein the motor includes a pinion for directly engaging the first inker drive gear.

4. The printing unit as recited in claim 1, wherein the first inker drive gear is a compound gear having a first teething engaging the motor and a second teething engaging the gear train.

5. The printing unit as recited in claim 1, wherein the inker drive includes a first teething engaging the motor and the gear train.

6. The printing unit as recited in claim 1, wherein the gear train includes:

a first plate drive gear driving the first plate cylinder and engaging the first inker drive gear;

a first blanket drive gear engaging the first plate drive gear and driving the first blanket cylinder;

a second blanket drive gear engaging the first blanket drive gear and driving the second blanket cylinder;

a second plate drive gear engaging the second blanket drive gear and driving the second plate cylinder; and a second inker drive gear engaging the second plate drive gear and driving the second inker.

7. The printing unit as recited in claim 1, wherein the gear train includes a plurality of gears, each of the plurality of gears being associated with one of the first and second blanket cylinders, the first and second plate cylinders, and the second inker.

8. The printing unit as recited in claim 7, wherein each of the first and second blanket cylinders and the first and second plate cylinders have a diameter equal to a diameter of the associated gear of the gear train.

9. The printing unit as recited in claim 8, wherein the diameter of each of the plurality of gears of the gear train is equal each other.

10. A method of driving a printing unit, comprising:

driving a first inker drive gear using a motor associated with the printing unit;

driving a first inker connected to the first inker drive gear using the first inker drive gear; and driving a first plate cylinder, a first blanket cylinder, a second blanket cylinder, a second plate cylinder and a second inker using a gear train, the gear train engaging and being driven by the first inker drive gear.

11. The method as recited in claim 10, further comprising engaging the motor directly with the first inker drive gear.

12. The method as recited in claim 10, wherein the motor includes a pinion for directly engaging the first inker drive gear.

13. The method as recited in claim 10, wherein the first inker drive gear is a compound gear having a first teething engaging the motor and a second teething engaging the gear train.

14. The method as recited in claim 10, wherein the inker drive includes a first teething engaging the motor and the gear train.

15. The method as recited in claim 10, wherein the gear train includes a plurality of gears, each of the plurality of gears being associated with one of the first and second blanket cylinders, the first and second plate cylinders, and the second inker.

16. The method as recited in claim 15, wherein each of the first and second blanket cylinders and the first and second plate cylinders have a diameter equal to a diameter of the associated gear of the gear train.

17. The method as recited in claim 15, wherein the diameter of each of the plurality of gears of the gear train is equal each other.

* * * * *